US010130184B2

(12) United States Patent
Lin et al.

(10) Patent No.: US 10,130,184 B2
(45) Date of Patent: Nov. 20, 2018

(54) ADJUSTING MECHANISM AND CHAIR INCLUDING THE SAME

(71) Applicant: PAO SHEN ENTERPRISES CO., LTD., Chang Hua (TW)

(72) Inventors: Chen-Yu Lin, Chang Hua (TW); Jung-Feng Chen, Chang Hua (TW)

(73) Assignee: PAO SHEN ENTERPRISES CO., LTD., Chang Hua (TW)

( * ) Notice: Subject to any disclaimer, the term of this patent is extended or adjusted under 35 U.S.C. 154(b) by 0 days.

(21) Appl. No.: 15/725,466

(22) Filed: Oct. 5, 2017

(65) Prior Publication Data

US 2018/0098633 A1 Apr. 12, 2018

(30) Foreign Application Priority Data

Oct. 7, 2016 (TW) ..... 105132495 A

(51) Int. Cl.

| | |
|---|---|
| ***A47C 3/025*** | (2006.01) |
| ***A47C 3/026*** | (2006.01) |
| ***A47C 7/44*** | (2006.01) |
| ***A47C 1/032*** | (2006.01) |

(52) U.S. Cl.

CPC ..... *A47C 7/443* (2013.01); *A47C 1/03266* (2013.01); *A47C 1/03272* (2013.01)

(58) Field of Classification Search

CPC .. A47C 1/03266; A47C 1/03272; A47C 7/443
USPC ..... 297/300.1–300.8
See application file for complete search history.

(56) References Cited

U.S. PATENT DOCUMENTS

| | | | | |
|---|---|---|---|---|
| 4,189,179 | A * | 2/1980 | De Graaf | A47C 3/026 297/302.4 |
| 4,328,943 | A * | 5/1982 | Eldon, III | A47C 3/026 248/161 |
| 4,709,963 | A * | 12/1987 | Uecker | A47C 1/03255 297/300.5 |
| 5,207,479 | A * | 5/1993 | Wickman | A47C 3/026 297/302.4 |
| 5,397,165 | A * | 3/1995 | Grin | A47C 1/03255 297/300.5 |
| 5,601,337 | A * | 2/1997 | Choda | A47C 1/03255 297/300.2 |
| 5,772,282 | A * | 6/1998 | Stumpf | A47C 1/03 297/300.7 |

(Continued)

FOREIGN PATENT DOCUMENTS

| | | |
|---|---|---|
| TW | 474141 U | 1/2002 |
| TW | M336732 U | 7/2008 |

*Primary Examiner* — Rodney B White
(74) *Attorney, Agent, or Firm* — Foley & Lardner LLP

(57) ABSTRACT

An adjusting mechanism is provided for selectively setting a restoring force acting on a backrest of a chair. In a biasing unit of the adjusting mechanism, a spring segment is disposed between a head end and a follower end to bias the follower end to the remote position. The follower end is angularly movable on a cam surface between distal and proximate positions. In response to movement of a backrest of the chair from a normal position to an inclined position to permit the follower end to be forced by the cam surface to move from the remote position to a close position, two different restoring forces can be set by adjusting the follower end between the distal and proximate positions.

11 Claims, 10 Drawing Sheets

(56) References Cited

U.S. PATENT DOCUMENTS

| | | | | |
|---|---|---|---|---|
| 6,238,000 | B1 * | 5/2001 | Hallmark | A47C 1/03238<br>297/300.5 |
| 6,250,715 | B1 * | 6/2001 | Caruso | A47C 1/03<br>297/300.2 |
| 6,447,063 | B1 * | 9/2002 | Beggs | A47C 1/03255<br>297/300.5 |
| 8,528,973 | B2 | 9/2013 | Sander et al. | |
| 9,265,348 | B2 | 2/2016 | Potrykus | |
| 2006/0255636 | A1 * | 11/2006 | Donati | A47C 1/025<br>297/301.1 |
| 2008/0054700 | A1 * | 3/2008 | Meidan | A47C 1/03238<br>297/361.1 |
| 2010/0244521 | A1 * | 9/2010 | Ueda | A47C 1/03255<br>297/298 |
| 2013/0234485 | A1 * | 9/2013 | Gorgi | A47C 1/03238<br>297/303.2 |
| 2014/0300164 | A1 * | 10/2014 | Oda | A47C 1/03266<br>297/354.1 |

* cited by examiner

ADJUSTING MECHANISM AND CHAIR INCLUDING THE SAME

CROSS-REFERENCE TO RELATED APPLICATION

This application claims priority from Taiwanese patent application no. 105132495, filed on Oct. 7, 2016.

FIELD

The disclosure relates to an adjusting mechanism, more particularly to an adjusting mechanism for selectively setting a restoring force acting on a backrest of a chair.

BACKGROUND

For users of different weights, an office chair may be adjusted to selectively set a restoring force acting on a backrest of the chair.

U.S. Pat. No. 8,528,973 B2 discloses a conventional adjusting mechanism used to adjust a restoring force that acts on a backrest of a chair. The adjusting mechanism has a spring element for creating the restoring force, a support, and a backrest support that is pivotably mounted about a support axis on the support. An adjusting element configured as a pair of scissors containing a first scissor arm and a second scissor arm is provided, and the scissor arms are rotatably connected to each other about a scissor axis. The first scissor arm is pivotably mounted on the backrest support about an adjusting axis. A spring force produced by the spring element acts on the second scissor arm. A first actuating lever length is defined between the support axis and the scissor axis. The lever length is changeable using an adjusting element for adjusting the restoring force by pivoting the adjusting element about the adjusting axis.

U.S. Pat. No. 9,265,348 B2 discloses a conventional adjusting mechanism serves for the weight-dependent setting of a restoring force which acts on a backrest of an office chair which is configured with a synchronous mechanism. The synchronous mechanism comprises a support, a seat support and a backrest support which are connected to one another via joint pins, the restoring force being exerted via a spring element. In order to achieve as flat a design as possible, the restoring force is transmitted with the aid of a pivotable lever via a front bearing pin to a first front joint pin, an active lever length which can be varied with the aid of an adjusting element being defined by the spacing between the bearing pin and the second front joint pin. A weight setting is made possible by the variation of the active lever length.

SUMMARY

An object of the disclosure is to provide a novel adjusting mechanism for selectively setting a restoring force acting on a backrest of a chair, which has a simple and durable configuration, and which can be adjusted more easily. In addition, the novel adjusting mechanism can be assembled easily and be manufactured at low cost.

According to a first aspect of the disclosure, an adjusting mechanism is used for selectively setting a restoring force acting on a backrest of a chair. The chair includes the backrest, a backrest support, a seat, a seat support, a front axle, and a rear axle. The backrest is angularly moveable from a normal position to an inclined position where a user rests on the backrest. The backrest support includes a base segment and an upright segment which is secured to the backrest for supporting the backrest. The seat support is disposed under the seat, and includes two side frames which are spaced apart from each other in a left-to-right direction. Each of the side frames has a forward segment and a rearward segment opposite to each other in a front-to-rear direction. The front axle extends along a front axis in the left-to-right direction, and is disposed to interconnect the forward segments of the side frames. The rear axle extends along a rear axis in the left-to-right direction, and is disposed to interconnect the rearward segments of the side frames. The adjusting mechanism includes a mounting frame, a pivot axle, a force varying unit, a biasing unit, and a switching unit. The mounting frame includes a left wall and a right wall which are spaced from each other in the left-to-right direction to define an accommodation space therebetween. Each of the left and right walls has a rear segment formed with a rear through hole, and a front segment formed with a front through hole for permitting the front axle to extend therethrough thereby mounting the mounting frame hingedly to the front axle about the front axis. The pivot axle extends along a pivot axis in the left-to-right direction and through the rear through holes of the rear segments of the mounting frame. The force varying unit includes a base mount, a pair of lugs, and a cam member. The base mount is for securing to the base segment of the backrest support, and extends in the left-to-right direction to terminate at two marginal edges. The pair of lugs extend forwardly from the two marginal edges of the base mount to respectively terminate at two front end regions each of which is disposed inboard of a corresponding one of the left and right walls, and each of which is formed with a front opening configured to permit the pivot axle to extend therethrough such that the force varying unit is hingedly mounted to the mounting frame about the pivot axis. Each of the lugs has a rear opening in proximate to the base mount for permitting the rear axle to extend therethrough thereby mounting the force varying unit hingedly to the rear axle about the rear axis. The cam member is disposed below the pivot axle and between the lugs, and has a cam surface disposed to face forwardly and having a distal region and a proximate region relative to the pivot axle. The biasing unit defines a biasing axis, and includes a head end, a follower end, and a spring segment. The head end is for mounting pivotably to the front axle about the front axis. The follower end is opposite to the head end in a direction of the biasing axis, and is configured to be angularly movable about the front axis on the cam surface between a distal position, where the follower end is in pressing engagement with the distal region, and a proximate position, where the follower end is in pressing engagement with the proximate region. The follower end is movable relative to the head end along the biasing axis between a remote position, where the backrest is in the normal position and the follower end is remote from the head end, and a close position, where the backrest is in the inclined position and the follower end is close to the head end. The spring segment is disposed between the head end and the follower end in the accommodation space to bias the follower end to the remote position, and is configured to keep the follower end to be in pressing engagement with the cam surface by a first biasing force when the follower end is in the distal position or by a second biasing force when the follower end is in the proximate position such that when the follower end in the distal position is moved toward the close position against the first biasing force in response to movement of the backrest from the normal position to the inclined position, a first restoring force is generated for returning the backrest to the normal position, and such that when the follower end in the proximate position is moved toward the close position against the second biasing force in response to movement of the backrest from the normal position to the inclined position, a second restoring force different from the first restoring force is generated for returning the backrest to the normal position. The switching unit is coupled to the biasing unit so as to switch the follower end between the proximate and distal positions.

According to a second aspect of the disclosure, a chair including the adjusting mechanism is provided.

According to a third aspect of the disclosure, an adjusting mechanism for selectively setting a restoring force acting on a backrest of a chair. The chair includes a seat support having a forward segment and a rearward segment which are opposite to each other in a front-to-rear direction. The adjusting mechanism includes a mounting frame, a force varying unit, a biasing unit, and a switching unit. The mounting frame is for hingedly mounted relative to the seat support. The force varying unit is hingedly mounted relative to the seat support about a rear axis, and includes a base mount, a pivot axle, and a cam member. The base mount is for securing to the backrest. The pivot axle extends along a pivot axis in a left-to-right direction, and is configured such that the force varying unit is hingedly mounted to the mounting frame about the pivot axis. The cam member is disposed below the pivot axle, and has a cam surface disposed to face forwardly and having a distal region and a proximate region relative to the pivot axle. The biasing unit defines a biasing axis, and includes a head end, a follower end, and a spring segment. The head end is mounted pivotably relative to the mounting frame about a front axis. The follower end is opposite to the head end in a direction of the biasing axis, and is configured to be angularly movable about the front axis on the cam surface between a distal position, where the follower end is in pressing engagement with the distal region, and a proximate position, where the follower end is in pressing engagement with the proximate region. The follower end is movable relative to the head end along the biasing axis between a remote position, where the backrest is in a normal position and the follower end is remote from the head end, and a close position, where the backrest is in an inclined position and the follower end is close to the head end. The spring segment is disposed between the head end and the follower end to bias the follower end to the remote position, and is configured to keep the follower end to be in pressing engagement with the cam surface by a first biasing force when the follower end is in the distal position or by a second biasing force when the follower end is in the proximate position such that when the follower end in the distal position is moved toward the close position against the first biasing force in response to movement of the backrest from the normal position to the inclined position, a first restoring force is generated for returning the backrest to the normal position, and such that when the follower end in the proximate position is moved toward the close position against the second biasing force in response to movement of the backrest from the normal position to the inclined position, a second restoring force different from the first restoring force is generated for returning the backrest to the normal position. The switching unit is coupled to the biasing unit so as to switch the follower end between the proximate and distal positions.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
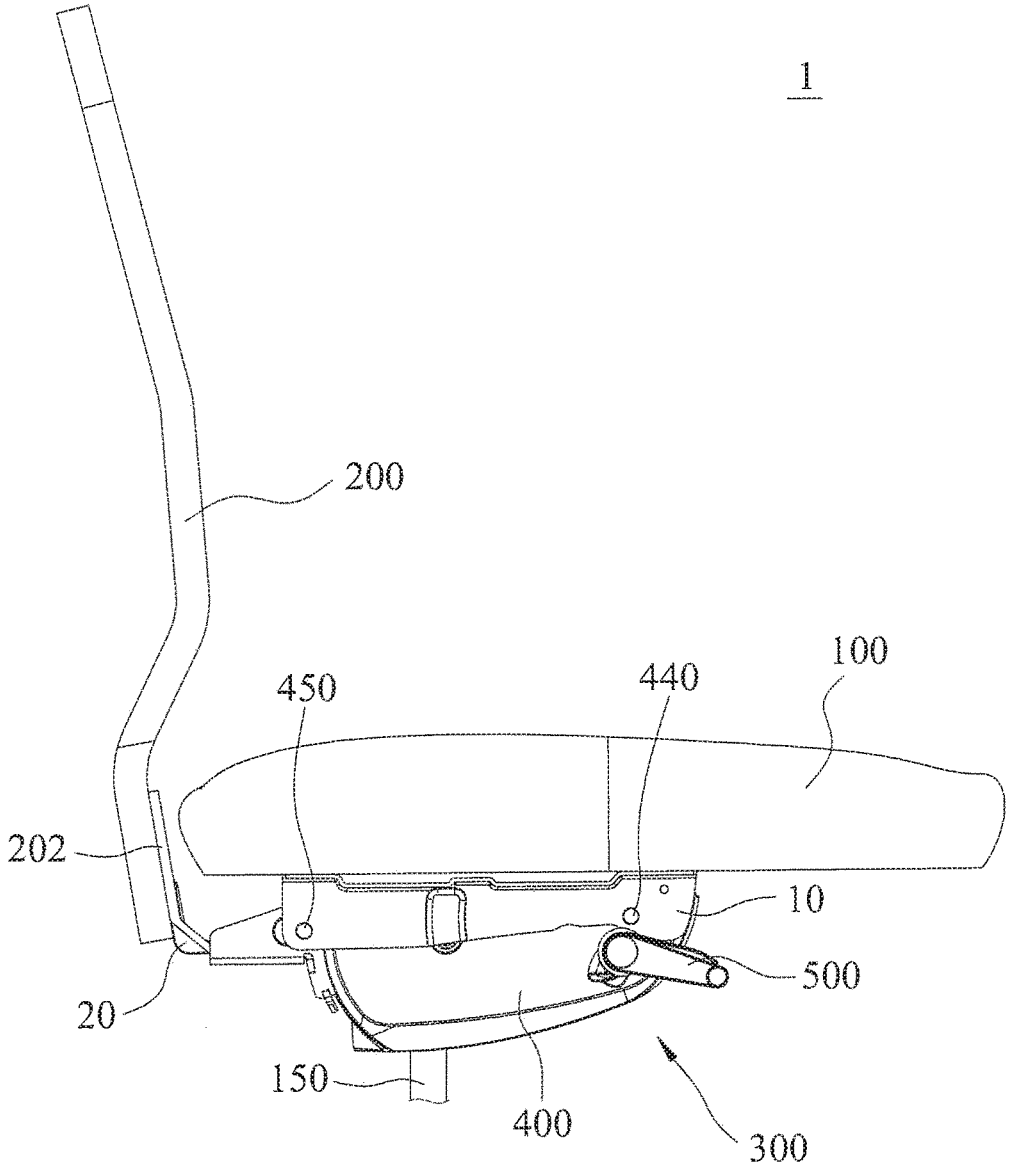
FIG. 1 is a side view of a chair which includes an adjusting mechanism according to an embodiment of the disclosure.
Figure 2:
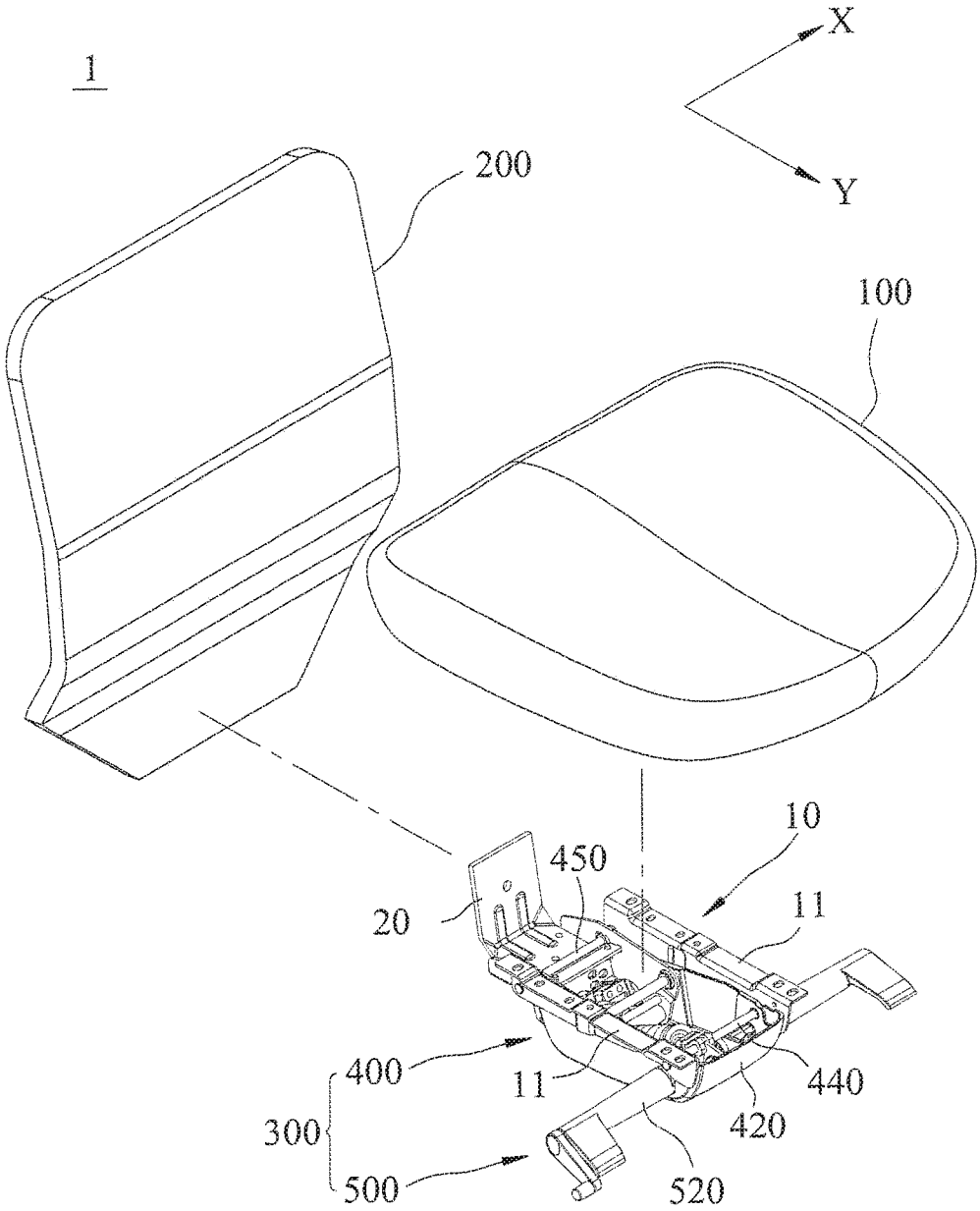
FIG. 2 is a partially-exploded perspective view of the chair shown in FIG. 1.

Referring to FIGS. 1 and 2, a chair 1 is shown to include a seat 100, a seat support 10, a standing tube 150, a backrest 200, a backrest support 20, a front axle 440, a rear axle 450, and an adjusting mechanism 300 according to an embodiment of the disclosure. The adjusting mechanism 300 is connected among the seat support 10, the backrest support 20, and the standing tube 150 for selectively setting a restoring force acting on the backrest 200.

Figure 4:
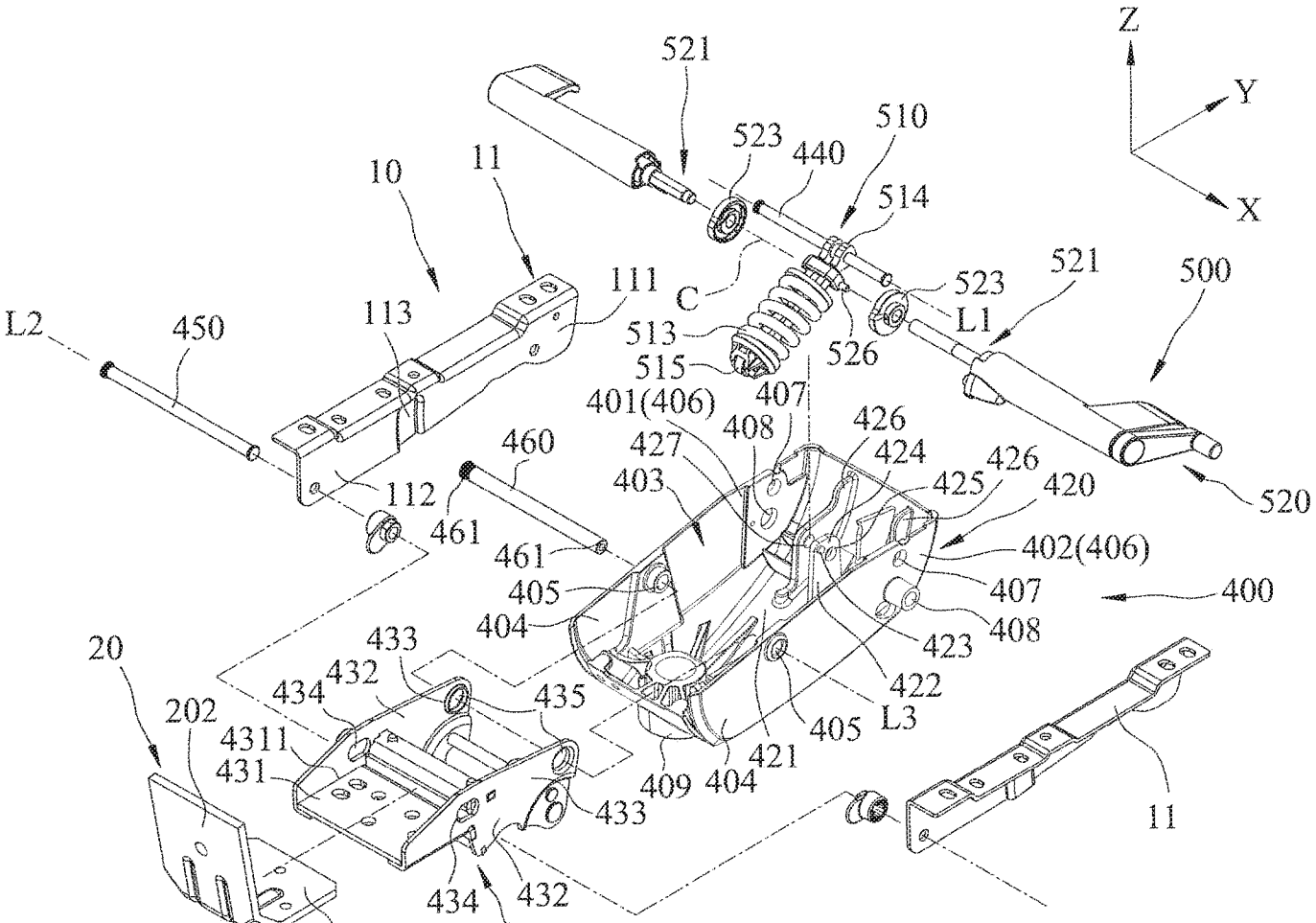
FIG. 4 is an exploded perspective view of the adjusting mechanism.

As shown in FIGS. 2 and 4, the seat support 10 is disposed under the seat 100, and includes two side frames 11 which are spaced apart from each other in a left-to-right direction (X). Each of the side frames 11 has a forward segment 111 and a rearward segment 112 which are opposite to each other in a front-to-rear direction (Y). In this embodiment, each of the side frames 11 has a recess 113 disposed between the forward and rearward segments 111, 112. The recesses 113 of the side frames 11 are arranged in line and confront each other in the left-to-right direction (X).

The backrest 200 is angularly moveable from a normal position (FIGS. 1, 7, and 9) to an inclined position (FIGS. 8 and 10) where a user (not shown) rests on the backrest 200.

Referring to FIGS. 1 and 4, it can be observed that the backrest support 20 includes a base segment 201 and an upright segment 202 which is secured to the backrest 200 for supporting the backrest 200.

As shown in FIGS. 2 and 4, the front axle 440 extends along a front axis (L1) in the left-to-right direction (X), and is disposed to interconnect the forward segments 111 of the side frames 11.

The rear axle 450 extends along a rear axis (L2) in the left-to-right direction (X), and is disposed to interconnect the rearward segments 112 of the side frames 11.

Figure 3:
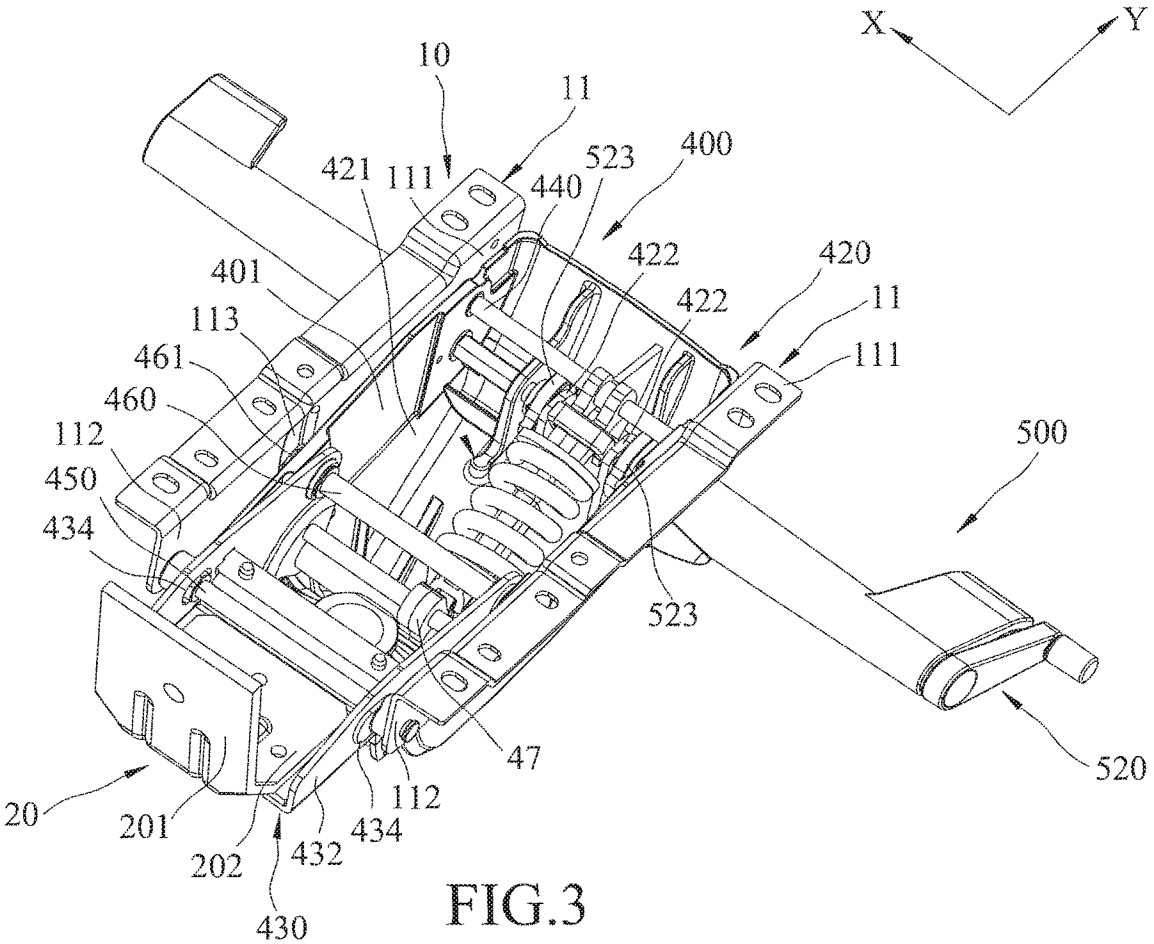
FIG. 3 is a perspective view of the adjusting mechanism according the embodiment of the disclosure.

With reference to FIGS. 3 and 4, the adjusting mechanism 300 is shown to include a mounting part 400 and a switching part 500. The mounting part 400 includes a mounting frame 420, a force varying unit 430, and a pivot axle 460. The switching part 500 includes a biasing unit 510 and a switching unit 520.

As best shown in FIG. 4, the mounting frame 420 includes a left wall 401 and a right wall 402 which are spaced from each other in the left-to-right direction (X) to define an accommodation space 403 therebetween. Each of the left and right walls 401, 402 has a rear segment 404 formed with a rear through hole 405, and a front segment 406 formed with a front through hole 407 configured to permit the front axle 440 to extend therethrough thereby mounting the mounting frame 420 hingedly to the front axle 440 about the front axis (L1) (see also FIG. 3).

The pivot axle 460 extends along a pivot axis (L3) in the left-to-right direction (X) and through the rear through holes 405 of the rear segments 404 of the mounting frame 420. The pivot axle 460 has two opposite ends 461 which are loosely mounted in the recesses 131, respectively, and which can be actuated to move together in an upright direction (Z).

Figure 6:
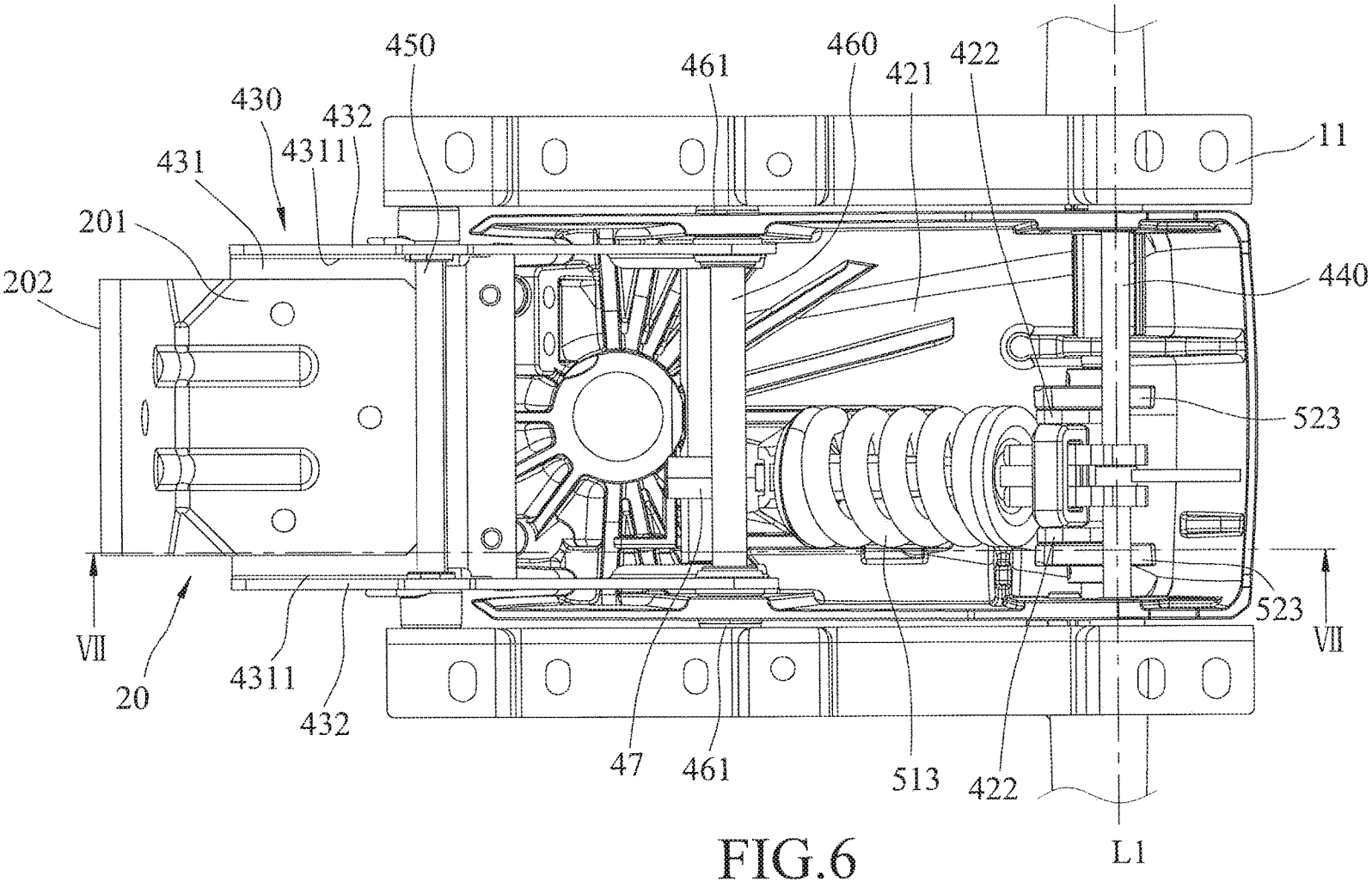
FIG. 6 is a top view of the adjusting mechanism.

As shown in FIGS. 3, 4, and 6, the force varying unit 430 includes a base mount 431, a pair of lugs 432, and a cam member 47.

The base mount 431 is configured for securing to the base segment 201 of the backrest support 20, and extends in the left-to-right direction (X) to terminate at two marginal edges 4311.

The lugs 432 extend forwardly from the two marginal edges 4311 of the base mount 431 to respectively terminate at two front end regions 433. Each of the front end regions 433 is disposed inboard of a corresponding one of the left and right walls 401, 402, and is formed with a front opening 435 configured to permit the pivot axle 460 to extend therethrough such that the force varying unit 430 is hingedly mounted to the mounting frame 420 about the pivot axis (L3). Each of the lugs 432 has a rear opening 434 in proximate to the base mount 431. The rear opening 434 is configured to permit the rear axle 450 to extend therethrough thereby mounting the force varying unit 430 hingedly to the rear axle 450 about the rear axis (L2). In this embodiment, the rear opening 434 is elongated for loose engagement of the rear-axle 450 therein.

Figure 7:
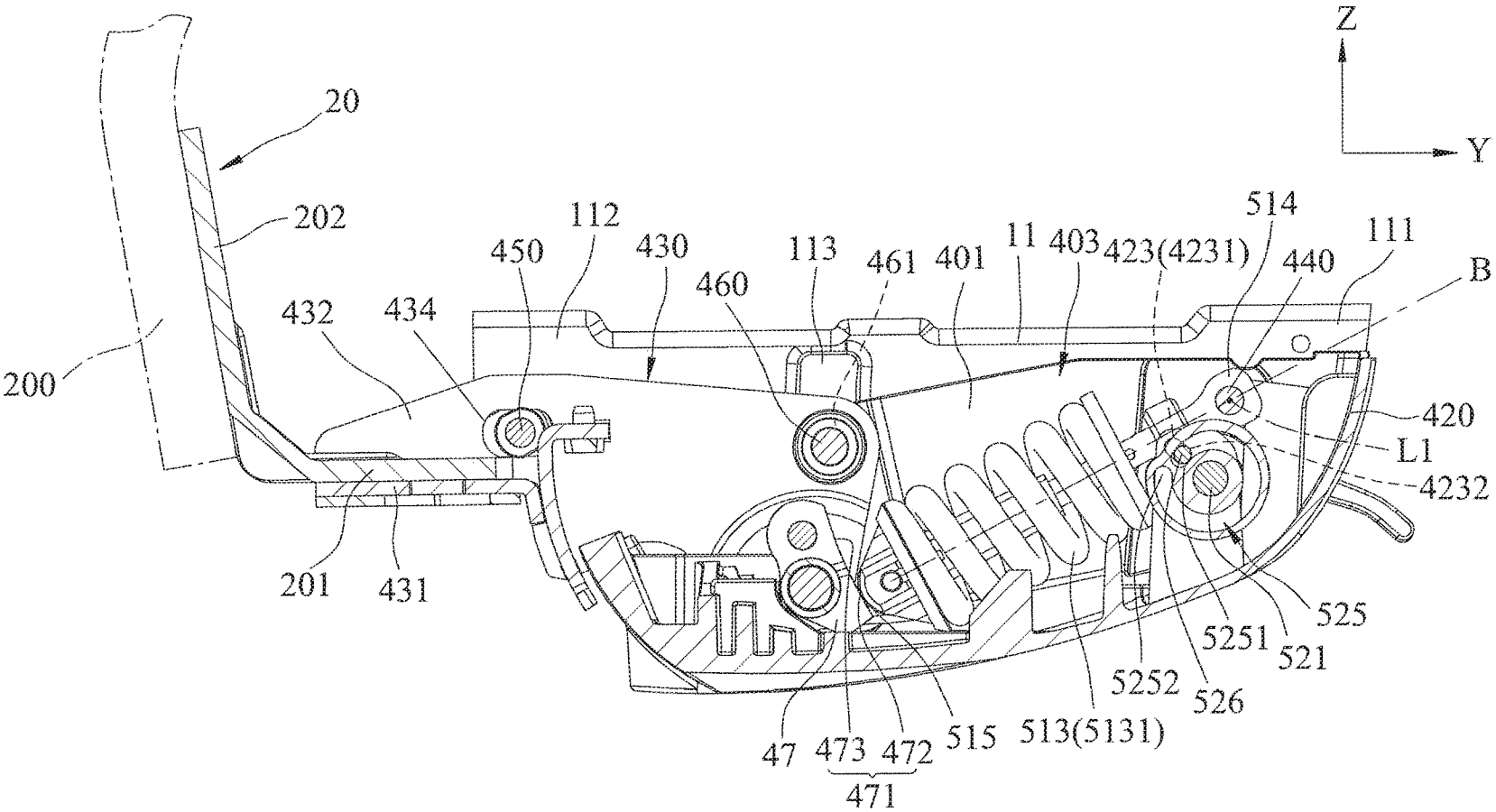
FIG. 7 is a cross-sectional view taken along line VII-VII of FIG. 6 for illustrating a follower end of the biasing unit in a remote position and a distal position.

As shown in FIGS. 6 and 7, the cam member 47 is disposed below the pivot axle 460 and between the lugs 432, and has a cam surface 471 which is disposed to face forwardly and which has a distal region 472 and a proximate region 473 relative to the pivot axle 460. In this embodiment, the cam surface 471 is disposed to face the front axle 440.

Figure 5:
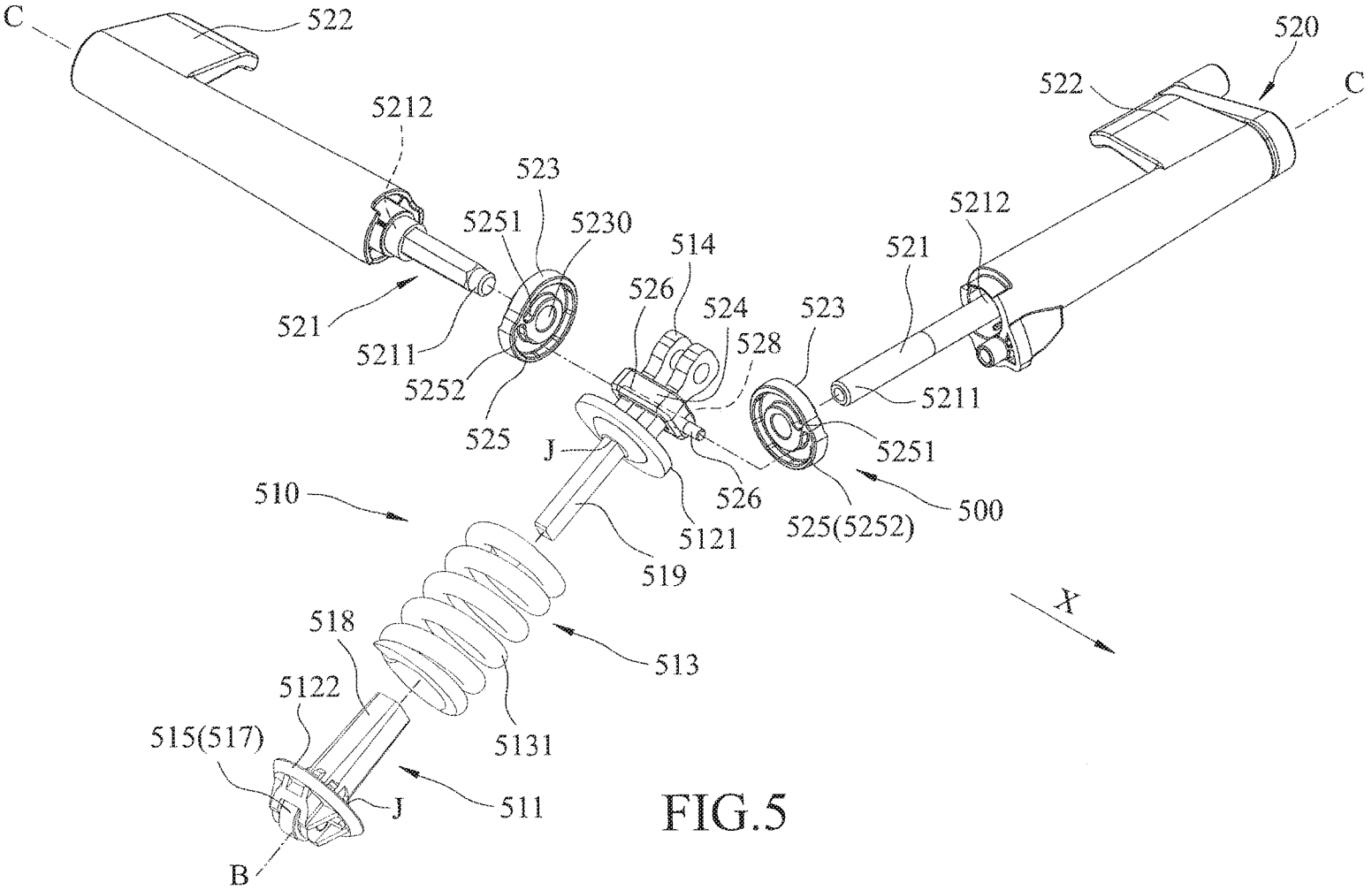
FIG. 5 is an exploded perspective view of a biasing unit and a switching unit.

With reference to FIG. 5, it can be observed that the biasing unit 510 defines a biasing axis (B), and includes a head end 514, a follower end 515, and a spring segment 513.

As shown in FIGS. 4, 5, and 7, the head end 514 is mounted pivotably to the front axle 440 about the front axis (L1).

Figure 8:
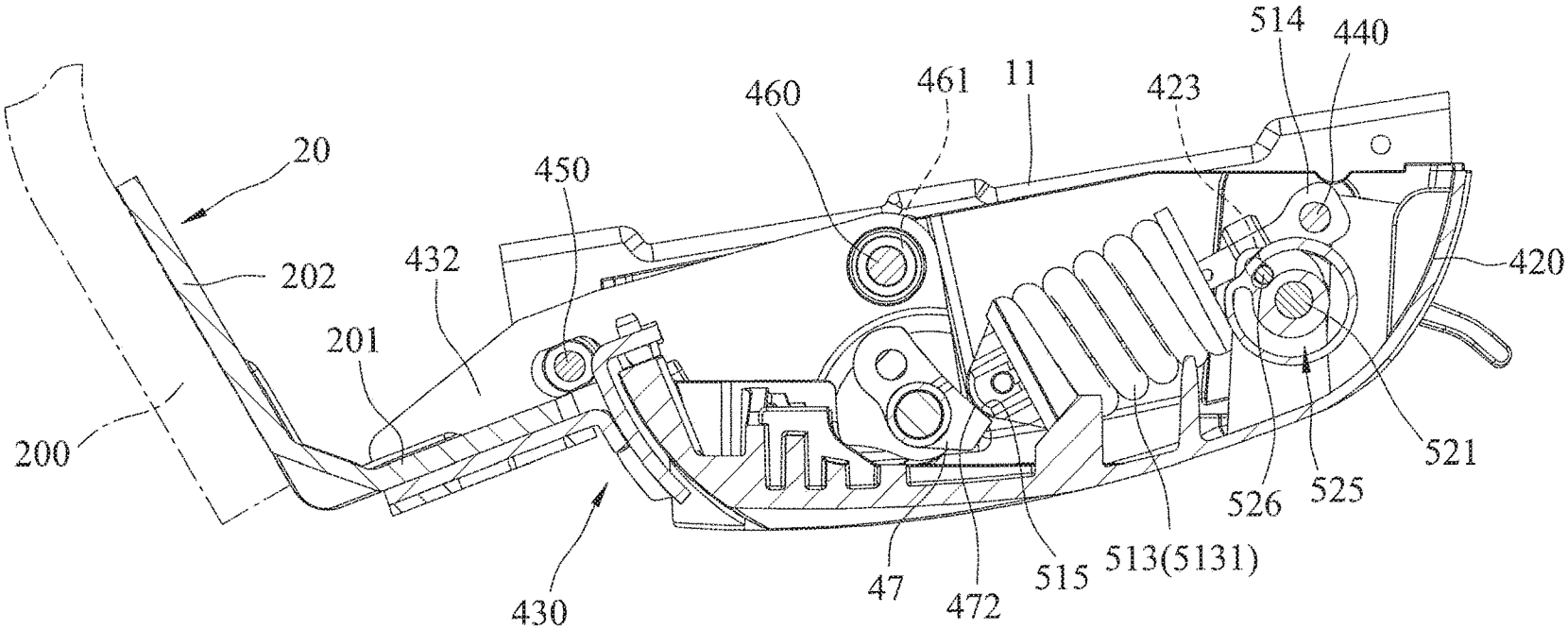
FIG. 8 is similar to FIG. 7 but illustrating the follower end in a close position and the distal position.
Figure 9:
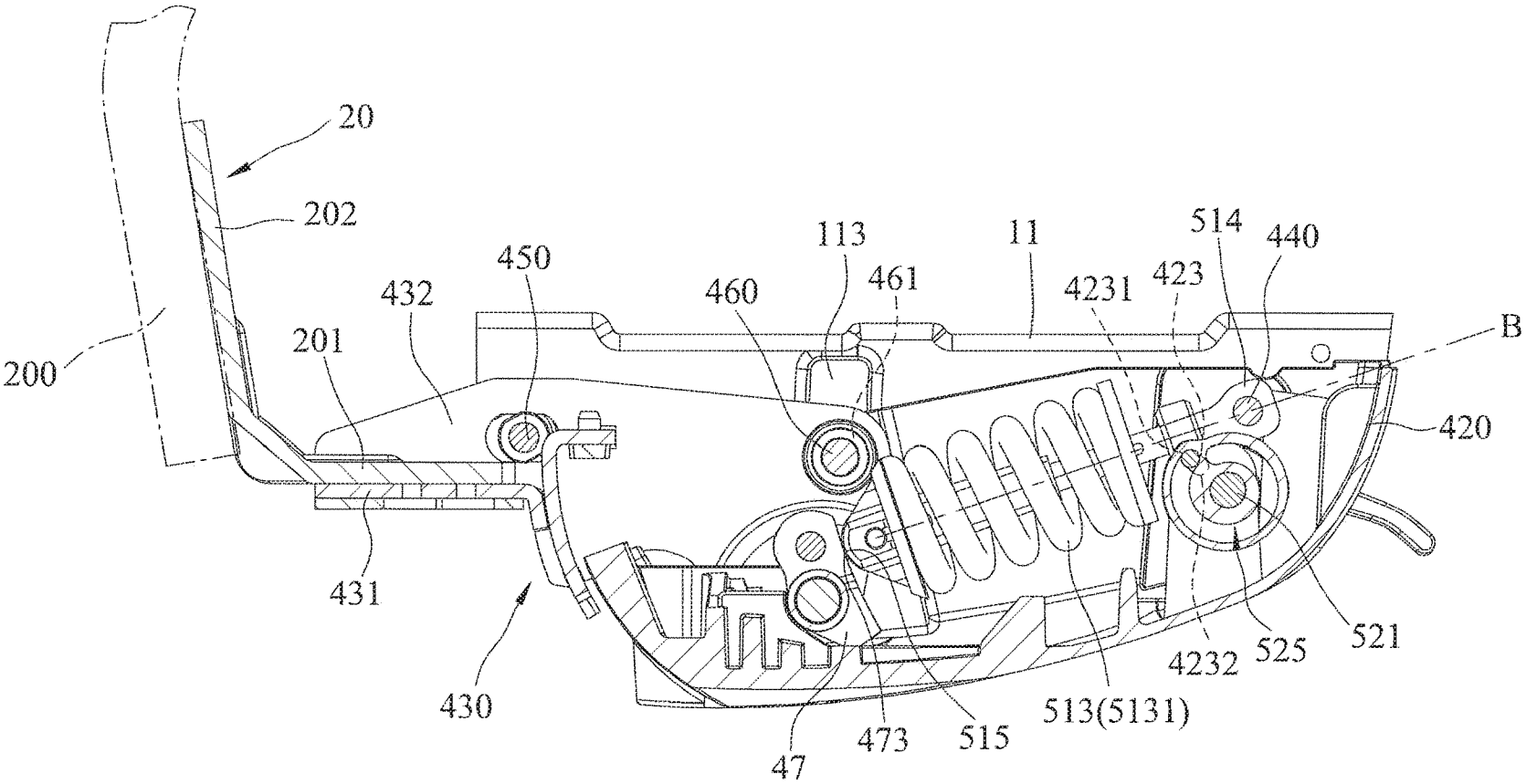
FIG. 9 is similar to FIG. 7 but illustrating the follower end in a remote position and a proximate position.
Figure 10:
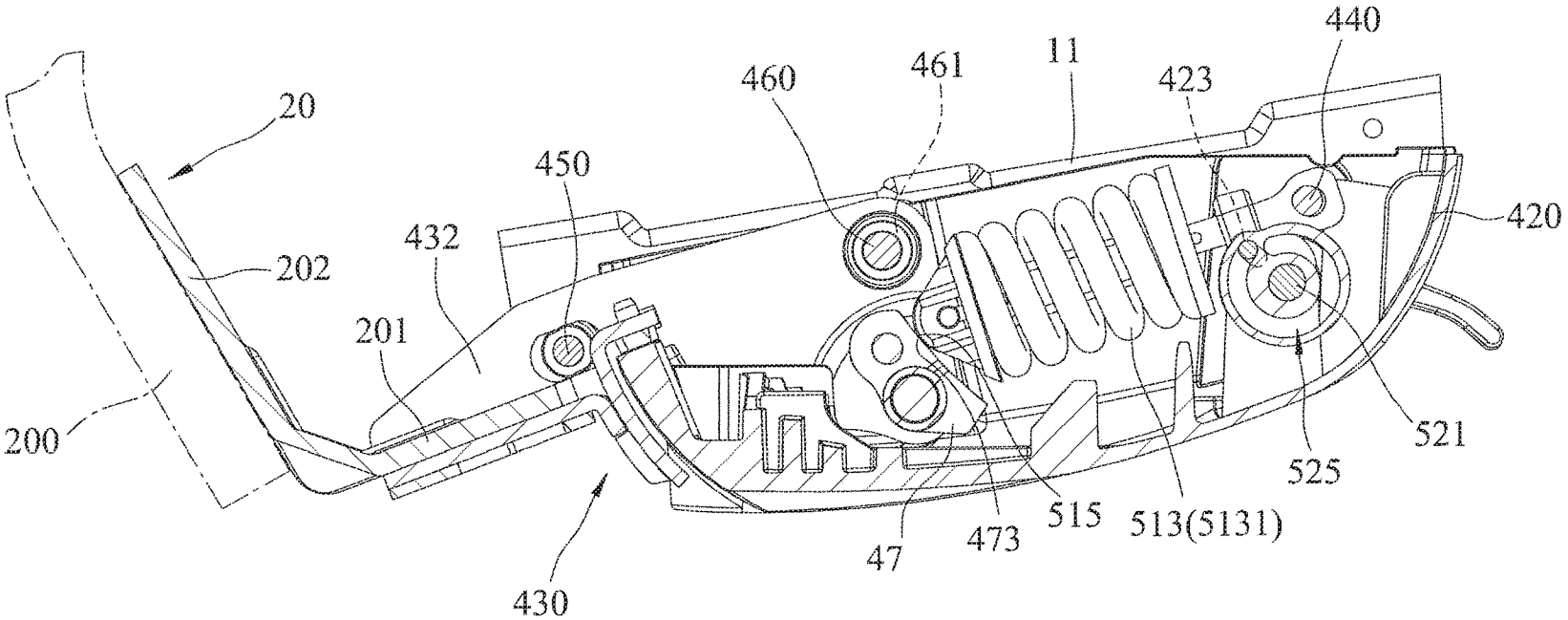
FIG. 10 is similar to FIG. 9 but illustrating the follower end in a close position and the proximate position.

The follower end 515 is opposite to the head end 514 in a direction of the biasing axis (B), and is configured to be angularly movable about the front axis (L1) on the cam surface 471 between a distal position and a proximate position. In the distal position, as shown in FIGS. 7 and 8, the follower end 515 is in pressing engagement with the distal region 472. In the proximate position, as shown in FIGS. 9 and 10, the follower end 515 is in pressing engagement with the proximate region 473. In addition, the follower end 515 is movable relative to the head end 514 along the biasing axis (B) between a remote position and a close position. In the remote position, as shown in FIGS. 7 and 9, the backrest 200 is in the normal position and the follower end 515 is remote from the head end 514. In the close position, as shown in FIGS. 8 and 10, the backrest 200 is in the inclined position and the follower end 515 is close to the head end 514.

The spring segment 513 is disposed between the head end 514 and the follower end 515 in the accommodation space 403 to bias the follower end 515 to the remote position (see FIGS. 7 and 9). The spring segment 513 is configured to keep the follower end 515 to be in pressing engagement with the cam surface 471 by a first biasing force when the follower end 515 is in the distal position (FIGS. 7 and 8) or by a second biasing force when the follower end 515 is in the proximate position.

When the follower end 515 in the distal position is moved toward the close position against the first biasing force in response to movement of the backrest 200 from the normal position (FIG. 7) to the inclined position (FIG. 8), a first restoring force is generated for returning the backrest 200 to the normal position (FIG. 7).

When the follower end 515 in the proximate position is moved toward the close position against the second biasing force in response to movement of the backrest 200 from the normal position (FIG. 9) to the inclined position (FIG. 10), a second restoring force different from the first restoring force is generated for returning the backrest 200 to the normal position (FIG. 9).

In this embodiment, the distal region 472 of the cam surface 471 is proximate to the head end 514, and the proximate region 473 of the cam surface 471 is distal from the head end 514. Therefore, the first biasing force is larger than the second biasing force, and the first restoring force is larger than the second restoring force. In addition, the distal region 472 is more distal from the pivot axle 460 than the proximate region 473. As such, when the follower end 515 is in the distal position (FIGS. 7 and 8), in response to the movement of the backrest 200 from the normal position (FIG. 7) to the inclined position (FIG. 8), a relatively large torque about the pivot axle 460 would be applied to the backrest 200 for returning the backrest 200 to the normal position (FIG. 7). When the follower end 515 is in the proximate position (FIGS. 9 and 10), in response to the movement of the backrest 200 from the normal position (FIG. 9) to the inclined position (FIG. 10), a relatively small torque about the pivot axle 460 would be applied to the backrest 200 for returning the backrest 200 to the normal position (FIG. 9).

Therefore, the restoring forces may be selected base on user's requirements.

As shown in FIG. 5, the biasing unit 510 further includes a telescopic rod 511, a first limiting flange 5121, a second limiting flange 5122, a spring member 5131, and a roller 517.

The telescopic rod 511 includes a small-dimension rod segment 519 and a large-dimension tubular segment 518 which is telescopically joinable to the small-dimension rod segment 519. Each of the small-dimension rod segment 519 and the large-dimension rod segments 518 is connected to a corresponding one of the head end 514 and the follower end 515 at a corresponding juncture (J). In this embodiment, the small-dimension rod segment 519 is connected to the head end 514, and the large-dimension tubular segment 518 is connected to the follower end 515. Furthermore, the large-dimension tubular segment 518 is telescopically splined with the small-dimension rod segment 519. In this case, the small-dimension rod segment 519 and the large-dimension rod segments 518 cannot rotate relative to each other.

The first limiting flange 5121 is mounted on the corresponding juncture (J) proximate to the head end 514.

The second limiting flange 5122 is mounted on the corresponding juncture (J) proximate to the follower end 515.

The spring member 5131 is sleeved on the telescopic rod 511 and is configured to be compressed between the first and second limiting flanges 5121, 5122 to serve as the spring segment 513.

The roller 517 is rollably mounted to the second limiting flange 5122 to serve as the follower end 515.

The switching unit 520 is coupled to the biasing unit 510 so as to switch the follower end 515 between the distal position (FIGS. 7 and 8) and the proximate position (FIGS. 9 and 10).

In this embodiment, the switching unit 520 includes a follower pin 526 and a switching cam 523.

As shown in FIGS. 4 and 5, the follower pin 526 is disposed between the head end 514 and the first limiting flange 5121, and extends radially relative to the biasing axis (B) and toward one of the left and right walls 401, 402. The follower pin 526 is angularly movable about the front axis (L1) between an upper position and a lower position. In the upper position, as shown in FIGS. 9 and 10, the follower end 515 is in the proximate position. In the lower position, as shown in FIGS. 7 and 8, the follower end 515 is in the distal position.

The switching cam 523 is rotatably mounted in the accommodation space 403 about a cam axis (C) parallel to and offset from the front axis (L1). The switching cam 523 has a camming route 525 which is configured to guide the follower pin 526, and which extends about the cam axis (C) to terminate at a first end region 5251 proximate to the cam axis (C) and a second end region 5252 distal from the cam axis (C). When the switching cam 523 is driven to rotate one cycle in a clockwise direction to move the follower pin 526 to the first end region 5251 (see FIGS. 7 and 8), the follower pin 526 is in the lower position. When the switching cam 523 is driven to rotate one cycle in a counterclockwise direction to move the follower pin 526 to the second end region 5252 (see FIGS. 9 and 10), the follower pin 526 is in the upper position. Therefore, the biasing force of the spring segment 513 and the restoring force for restoring the backrest 200 can be easily adjusted by rotating the switching cam 523.

In this embodiment, the camming route 525 extends from the first region 5251 to the second end region 5252 along an angular line which is longer than a distance between the distal and proximate regions 472, 473 of the cam surface 471.

In this embodiment, the s witching cam 523 has a passing hole 5230 extending along the cam axis (C).

Said one of the left and right walls 401, 402 has a through bore 408 extending along the cam axis (C). The switching unit 520 further includes a switching shaft 521 and a hand-powered crank 522.

The switching shaft 521 extends along the cam axis (C) through the through bore 408 to terminate at an inner end segment 5211 and an outer end 5212, and is rotatable about the cam axis (C). The inner end segment 5211 is disposed in the accommodation space 403 to couple to drive the switching cam 523 to rotate with the switching shaft 521 about the cam axis (C). The outer end 5212 is disposed outwardly of the mounting frame 420.

In this embodiment, the inner end segment 5211 of the switching shaft 521 extends through the passing hole 5230 of the switching cam 523 which is configured to permit the switching cam 523 to be coupled to rotate with the switching shaft 521 about the cam axis (C).

In this embodiment, as shown in FIGS. 3 and 6, the mounting frame 420 further includes a bottom wall 421 and a post 422. The bottom wall 421 interconnects bottom edges of the left and right walls 401, 402. The post 422 extends upwardly from the bottom wall 421 to terminate at an upper portion 424 which is disposed inboard of the switching cam 523 and between the switching cam 523 and a mounting piece 524 (that will be explained more in detail hereinafter), and which a shaft hole 425 and an elongated slot 423 (see also FIG. 4).

The shaft hole 425 is configured to permit the inner end segment 5211 of the switching shaft 521 to extend therethrough.

The elongated slot 423 is configured to permit the follower pin 526 to extend therethrough to be guided by the camming route 525, and extends radially relative to the cam axis (C) to terminate at an upper end 4231 and a lower end 4232. When the follower pin 526 is in the upper position (FIGS. 9 and 10), the follower pin 526 is in abutting engagement with the upper end 4231. When the follower pin 526 is in the lower position (FIGS. 7 and 8), the follower pin 526 is in abutting engagement with the lower end 4232.

Moreover, as shown in FIG. 4, the mounting frame 420 further includes a tubular mount 409 which is secured to the bottom wall 421 in proximate to the rear segments 404 of the left arid right walls 401, 402, and which extends downwardly of the bottom wall 421. The tubular mount 409 is coupled to the standing tube 150 (only shown in FIG. 1) so as to permit the mounting frame 420 to be supported by the standing tube 150.

The hand-powered crank 522 is coupled to the outer end 5212 to drive the switching shaft 521 to rotate about the cam axis (C).

In this embodiment, as shown in FIGS. 4 and 5, the switching unit 520 includes two of the follower pins 526, two of the switching cam 523, two of the switching shafts 521, and two of the hand-powered crank 522.

In this embodiment, the two switching shafts 521 are in register with each other along the cam axis (C) and are configured to be coupled to each other by, for example, threaded engagement or press-fitting.

In this embodiment, as best shown in FIG. 5, the mounting piece 524 is secured between the head end 514 and the first limiting flange 5121. A mounting rod 528 is secured to the mounting piece 524, and extends in the left-to-right direction (X) and through the mounting piece 524 to terminate at two opposite ends which are disposed outwardly of the mounting piece 524 and which serve as the two of the follower pins 526, respectively.

In addition, the mounting frame 420 includes two of the post 422 disposed to flank the mounting piece 524 for supporting the two of the switching shafts 521, respectively. Furthermore, for stabilize a corresponding one of the switching shafts 521, the mounting frame 420 may further include one or more additional posts 426 each having an extension hole 427 configured to permit the corresponding switching shafts 521 to extend there through.

Furthermore, in this embodiment, the mounting frame 420 is hinged relative to the seat 100 about the front axis (L1), the force varying unit 430 together with the backrest 200 and the backrest support 20 is hinged relative to seat 100 about the rear axis (L2), and the force varying unit 430 is hingedly mounted to the mounting frame 420 about the pivot axis (L3). Based on the arrangements of the mounting frame 420 and the force varying unit 430, the backrest 200 can be inclined at a relatively large angle.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An adjusting mechanism for selectively setting a restoring force acting on a backrest of a chair, the chair including the backrest which is angularly moveable from a normal position to an inclined position where a user rests on the backrest, a backrest support including a base segment and an upright segment which is secured to the backrest for supporting the backrest, a seat, a seat support disposed under the seat, and including two side frames which are spaced apart from each other in a left-to-right direction, each of the side frames having a forward segment and a rearward segment which are opposite to each other in a front-to-rear direction, a front axle extending along a front axis in the left-to-right direction, and disposed to interconnect the forward segments of the side frames, and a rear axle extending along a rear axis in the left-to-right direction, and disposed to interconnect the rearward segments of the side frames, said adjusting mechanism comprising:

a mounting frame including a left wall and a right wall which are spaced from each other in the left-to-right direction to define an accommodation space therebetween, each of said left and right walls having a rear segment formed with a rear through hole, and a front segment formed with a front through hole for permitting the front axle to extend therethrough thereby mounting said mounting frame hingedly to the front axle about the front axis;

a pivot axle extending along a pivot axis in the left-to-right direction and through said rear through holes of said rear segments of said mounting frame;

a force varying unit including a base mount for securing to the base segment of the backrest support, and extending in the left-to-right direction to terminate at two marginal edges, a pair of lugs extending forwardly from said two marginal edges of said base mount to respectively terminate at two front end regions each of which is disposed inboard of a corresponding one of said left and right walls, and each of which is formed with a front opening configured to permit said pivot axle to extend therethrough such that said force varying unit is hingedly mounted to said mounting frame about the pivot axis, each of said lugs having a rear opening in proximate to said base mount for permitting the rear axle to extend therethrough thereby mounting said force varying unit hingedly to the rear axle about the rear axis, and a cam member which is disposed below said pivot axle and between said lugs, and which has a cam surface disposed to face forwardly and having a distal region and a proximate region relative to said pivot axle;

a biasing unit defining a biasing axis, and including a head end for mounting pivotably to the front axle about the front axis, a follower end which is opposite to said head end in a direction of the biasing axis, and which is configured to be angularly movable about the front axis on said cam surface between a distal position, where said follower end is in pressing engagement with said distal region, and a proximate position, where said follower end is in pressing engagement with said proximate region, said follower end being movable relative to said head end along the biasing axis between a remote position, where the backrest is in the normal position and said follower end is remote from said head end, and a close position, where the backrest is in the inclined position and said follower end is close to said head end, and a spring segment which is disposed between said head end and said follower end in said accommodation space to bias said follower end to said remote position, and which is configured to keep said follower end to be in pressing engagement with said cam surface by a first biasing force when said follower end is in said distal position or by a second biasing force when said follower end is in said proximate position such that when said follower end in said distal position is moved toward said close position against said first biasing force in response to movement of the backrest from the normal position to the inclined position, a first restoring force is generated for returning the backrest to the normal position, and such that when said follower end in said proximate position is moved toward said close position against said second biasing force in response to movement of the backrest from the normal position to the inclined position, a second restoring force different from said first restoring force is generated for returning the backrest to the normal position; and a switching unit coupled to said biasing unit so as to switch said follower end between said proximate and distal positions.

2. The adjusting mechanism according to claim 1, wherein said first biasing force is larger than said second biasing force, and said first restoring force is larger than said second restoring force.

3. The adjusting mechanism according to claim 1, wherein said biasing unit further includes a telescopic rod including a small-dimension rod segment and a large-dimension tubular segment which is telescopically joinable to said small-dimension rod segment, each of said small-dimension rod segment and said large-dimension tubular segment being connected to a corresponding one of said head end and said follower end at a corresponding juncture, a first limiting flange which is mounted on said corresponding juncture proximate to said head end, a second limiting flange which is mounted on said corresponding juncture proximate to said follower end, and a spring member sleeved on said telescopic rod and configured to be compressed between said first and second limiting flanges to serve as said spring segment.

4. The adjusting mechanism according to claim 3, wherein said biasing unit includes a roller which is rollably mounted to said second limiting flange to serve as said follower end.

5. The adjusting mechanism according to claim 3, wherein said switching unit includes a follower pin which is disposed between said head end and said first limiting flange, and which extends radially relative to the biasing axis and toward one of said left and right walls, said follower pin being angularly movable about the front axis between an upper position, where said follower end is in said proximate position, and a lower position, where said follower end is in said distal position, and a switching cam rotatably mounted in said accommodation space about a cam axis parallel to and offset from the front axis, said switching cam having a camming route which is configured to guide said follower pin, and which extends about the cam axis to terminate at a first end region proximate to the cam axis and a second end region distal from the cam axis such that when said follower pin is moved to said first end region, said follower pin is in said lower position, and such that when said follower pin is moved to said second end region, said follower pin is in said upper position.

6. The adjusting mechanism according to claim 5, wherein said one of said left and right walls has a through bore extending along the cam axis, and said switching unit further includes a switching shaft which extends along the cam axis through said through bore to terminate at an inner end segment and an outer end and which is rotatable about the cam axis, said inner end segment being disposed in said accommodation space to couple to drive said switching cam to rotate with said switching shaft about the cam axis, said outer end being disposed outwardly of said mounting frame, and a hand-powered crank coupled to said outer end to drive said switching shaft to rotate about the cam axis.

7. The adjusting mechanism according to claim 5, wherein:

said switching cam has a passing hole which extends along the cam axis, and which is configured to permit said inner end segment of said switching shaft to extend therethrough, and to permit said switching cam to be coupled to rotate with said switching shaft about the cam axis; and said mounting frame further includes a bottom wall interconnecting bottom edges of said left and right walls, and a post extending upwardly from said bottom wall to terminate at an upper portion which is disposed inboard of said switching cam, and which has a shaft hole configured to permit said inner end segment of said switching shaft to extend therethrough, and an elongated slot which is configured to permit said follower pin to extend therethrough to be guided by said camming route, and which extends radially relative to the cam axis to terminate at an upper end and a lower end such that when said follower pin is in said upper position, said follower pin is in abutting engagement with said upper end, and such that when said follower pin is in said lower position, said follower pin is in abutting engagement with said lower end.

8. The adjusting mechanism according to claim 5, wherein said camming route extends from said first end region to said second end region along an angular line which is longer than a distance between said distal and proximate regions of said cam surface.

9. The adjusting mechanism according to claim 1, wherein said rear opening is elongated for loose engagement of the rear axle therein.

10. A chair comprising an adjusting mechanism according to claim 1.

11. An adjusting mechanism for selectively setting a restoring force acting on a backrest of a chair, the chair including a seat support having a forward segment and a rearward segment which are opposite to each other in a front-to-rear direction, said adjusting mechanism comprising:

a mounting frame for hingedly mounted relative to the seat support;

a force varying unit being hingedly mounted relative to the seat support about a rear axis, and including a base mount for securing to the backrest, a pivot axle extending along a pivot axis in a left-to-right direction, and configured such that said force varying unit is hingedly mounted to said mounting frame about the pivot axis, and a cam member which is disposed below said pivot axle, and which has a cam surface disposed to face forwardly and having a distal region and a proximate region relative to said pivot axle;

a biasing unit defining a biasing axis, and including a head end mounted pivotably relative to said mounting frame about a front axis, a follower end which is opposite to said head end in a direction of the biasing axis, and which is configured to be angularly movable about the front axis on said cam surface between a distal position, where said follower end is in pressing engagement with said distal region, and a proximate position, where said follower end is in pressing engagement with said proximate region, said follower end being movable relative to said head end along the biasing axis between a remote position, where the backrest is in a normal position and said follower end is remote from said head end, and a close position, where the backrest is in an inclined position and said follower end is close to said head end, and a spring segment which is disposed between said head end and said follower end to bias said follower end to said remote position, and which is configured to keep said follower end to be in pressing engagement with said cam surface by a first biasing force when said follower end is in said distal position or by a second biasing force when said follower end is in said proximate position such that when said follower end in said distal position is moved toward said close position against said first biasing force in response to movement of the backrest from the normal position to the inclined position, a first restoring force is generated for returning the backrest to the normal position, and such that when said follower end in said proximate position is moved toward said close position against said second biasing force in response to movement of the backrest from the normal position to the inclined position, a second restoring force different from said first restoring force is generated for returning the backrest to the normal position; and a switching unit coupled to said biasing unit so as to switch said follower end between said proximate and distal positions.

* * * * *